US007334967B2

(12) United States Patent
Blakseth et al.

(10) Patent No.: US 7,334,967 B2
(45) Date of Patent: Feb. 26, 2008

(54) METHOD AND ARRANGEMENT BY A WORKOVER RISER CONNECTION

(75) Inventors: Ola Blakseth, Bud (NO); Frode Johnsen, Bronnoysund (NO)

(73) Assignee: Blafro Tools AS (NO)

( * ) Notice: Subject to any disclaimer, the term of this patent is extended or adjusted under 35 U.S.C. 154(b) by 0 days.

(21) Appl. No.: 10/502,612

(22) PCT Filed: Jan. 30, 2003

(86) PCT No.: PCT/NO03/00026

§ 371 (c)(1),
(2), (4) Date: Jan. 25, 2005

(87) PCT Pub. No.: WO03/067023

PCT Pub. Date: Aug. 14, 2003

(65) Prior Publication Data

US 2005/0123358 A1 Jun. 9, 2005

(30) Foreign Application Priority Data

Feb. 8, 2002 (NO) ..... 20020654

(51) Int. Cl.
*E21B 7/12* (2006.01)

(52) U.S. Cl. ..... 405/224.2; 405/224.4; 166/355

(58) Field of Classification Search ..... 405/224.2, 405/224.4; 166/355
See application file for complete search history.

(56) References Cited

U.S. PATENT DOCUMENTS 3,955,621 A * 5/1976 Webb ..... 166/355
4,615,542 A * 10/1986 Ideno et al. ..... 285/11
6,148,922 A 11/2000 Vatne ..... 166/367
6,173,781 B1 1/2001 Milne et al.
6,422,324 B1 * 7/2002 Tibussek et al. ..... 175/5
6,470,969 B1 * 10/2002 Sørhaug et al. ..... 166/355
6,817,422 B2 * 11/2004 Jordan ..... 166/381
6,834,723 B2 * 12/2004 Jordan ..... 166/355

FOREIGN PATENT DOCUMENTS

| | | |
|---|---|---|
| GB | 2085051 A | 4/1982 |
| NO | B1-302493 | 3/1998 |
| NO | B1-310986 | 9/2001 |

* cited by examiner

*Primary Examiner*—Tara L. Mayo
(74) *Attorney, Agent, or Firm*—Akerman Senterfitt

(57) ABSTRACT

A slip joint for a riser between a well and a floating petroleum installation, for example an oil platform. The slip joint includes, an outer pipe and an inner pipe, the pipes arranged to enable telescopic movement relative to one another in order to compensate for a change in distance between the sea bottom and the platform. The inner pipe is connected to a piston, the piston being operable in response to hydraulic pressure for inflicting a tensile force on riser. The outer diameter of the inner pipe is adapted to the diameter of outer pipe so as to form an annulus between the pipes. The piston is fixedly connected to inner pipe at or close to a downwardly directed end thereof, the annulus and the piston being subjected to hydraulic pressure. A protective sleeve is provided below the piston, which is slippingly arranged within outer pipe.

2 Claims, 4 Drawing Sheets

METHOD AND ARRANGEMENT BY A WORKOVER RISER CONNECTION

FIELD OF THE INVENTION

Figure 1:
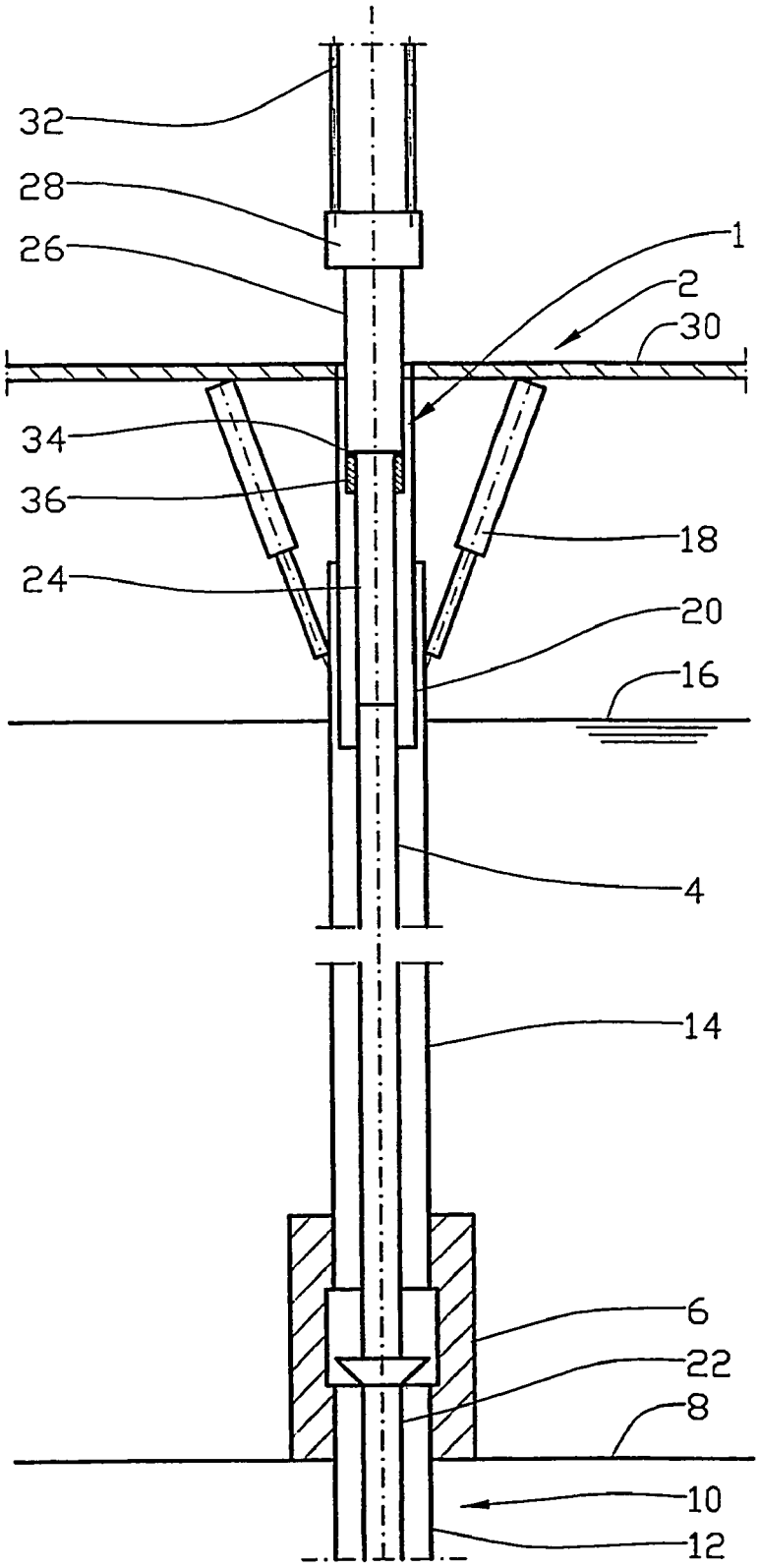

This invention regards a method of facilitating well operations from a vessel, in particular operations connected with well completion and well intervention, where use is made of a workover riser preferably equipped with surface valves, especially in connection with petroleum production. The invention also regards an arrangement for implementation of the method.

SUMMARY OF THE INVENTION

A common method of well completion is contingent upon a vessel equipped for the work operations in question being anchored or positioned over the well after the well has been drilled, cased and closed off. When the vessel has been positioned over the well, the well is opened and a wellhead comprising a number of valves and connecting pipes is lowered onto the seabed and connected to the casing. A riser is connected to the wellhead, projecting up through the sea to the vessel, where it is hung off in a heave compensator device designed to maintain tension in the riser during the heave motion of the vessel. A telescoping section of the riser may be connected to the vessel.

A production tubing is lowered into the well and hung off in the well head, whereupon a workover riser pipe is run into the riser and connected communicatingly to the production tubing. The workover riser is equipped with surface valves and suspended via a tensioner in the crane arrangement of the vessel. The surface valves comprise connections for various fluids and sluicing chambers for tools.

The area surrounding the surface valve is a work site for personnel during completion and intervention operations. The workover riser and the surface valves are connected to the seabed and are fixed, while the vessel is subjected to heave motion. Thus a certain amount of relative motion is imparted to the surface valve with respect to the vessel, and it is common for personnel during these types of operations to work in a harness in order to be able to follow the relative movements of the surface valve.

As a result of the danger that exists of personnel getting caught in the surface valve during such work, existing regulations do not allow work at the surface valve when the relative motion exceeds 1.5 meters. Clearly production is often interrupted in winter (windy periods) due to excessive heave motion.

The object of the invention is to remedy the disadvantages of prior art.

The object is achieved in accordance with the invention by a method for well completion and intervention operations where a workover riser projecting from a wellhead and up to a vessel is used. The upper portion of the workover riser is designed to be displaced from an upper position to a lowered position favorable for rigging work, where at least the upper displaceable portion of the workover riser essentially follows the heave motion of the vessel, whereupon the upper displaceable portion of the workover riser is again raised to its upper position.

By arranging the surface valve in a fixed position relative to the vessel, preferably immediately above the working deck, rigging work for well completion and intervention operations, and also to some degree the actual completion and intervention operations, could be carried out in a far simpler and safer manner, as the personnel would then be able to work on a fixed platform and use conventional safety equipment. It would also be possible to work during significantly greater heave, with interruptions in the work only being required when the heave motion exceeds the level tolerated by the adjoining equipment. As an example, the maximum heave motion for coiled tubing operations is approximately 4 meters. If the heave motion exceeds 4 to 5 meters, the workover riser must be disconnected from the wellhead in order to allow the riser to be disconnected from the wellhead in the case of the heave motion increasing further.

In order to be able to place the surface valves on the working deck during said operations, the workover riser is equipped with a telescoping, pressure-proof sliding connection. The sliding connection is disposed on the workover riser between the wellhead and the traveling block of the vessel and designed to telescope the sliding connection about its axial central position when the surface valves are immediately above the working deck. When the workover riser is to be pressurized, the telescoping sliding connection is extended to its limit of travel, and in this extended position it is designed to withstand the tensile forces that occur in workover risers of this type.

BREIF DESCRIPTION OF THE DRAWINGS

Figure 2:
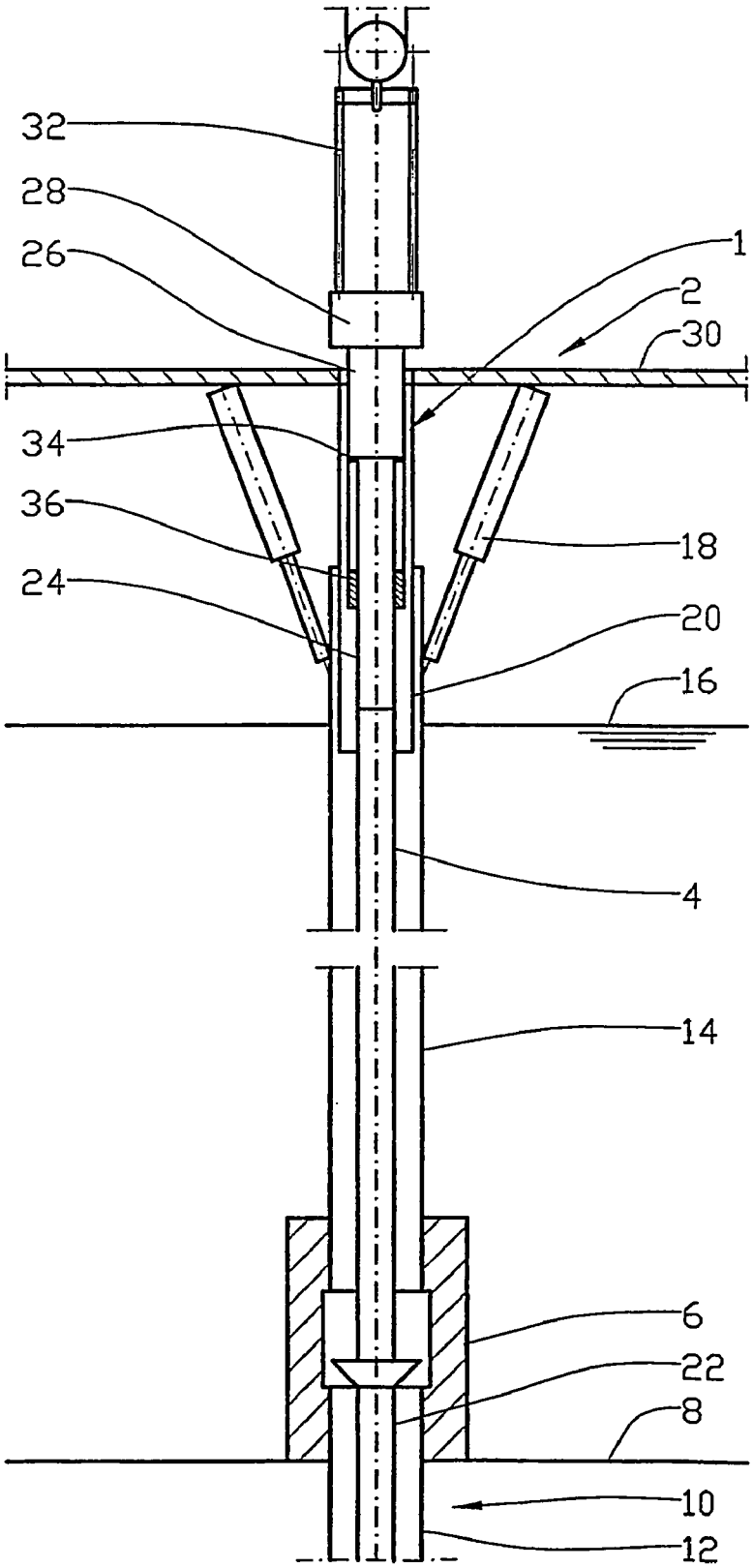
Figure 3:
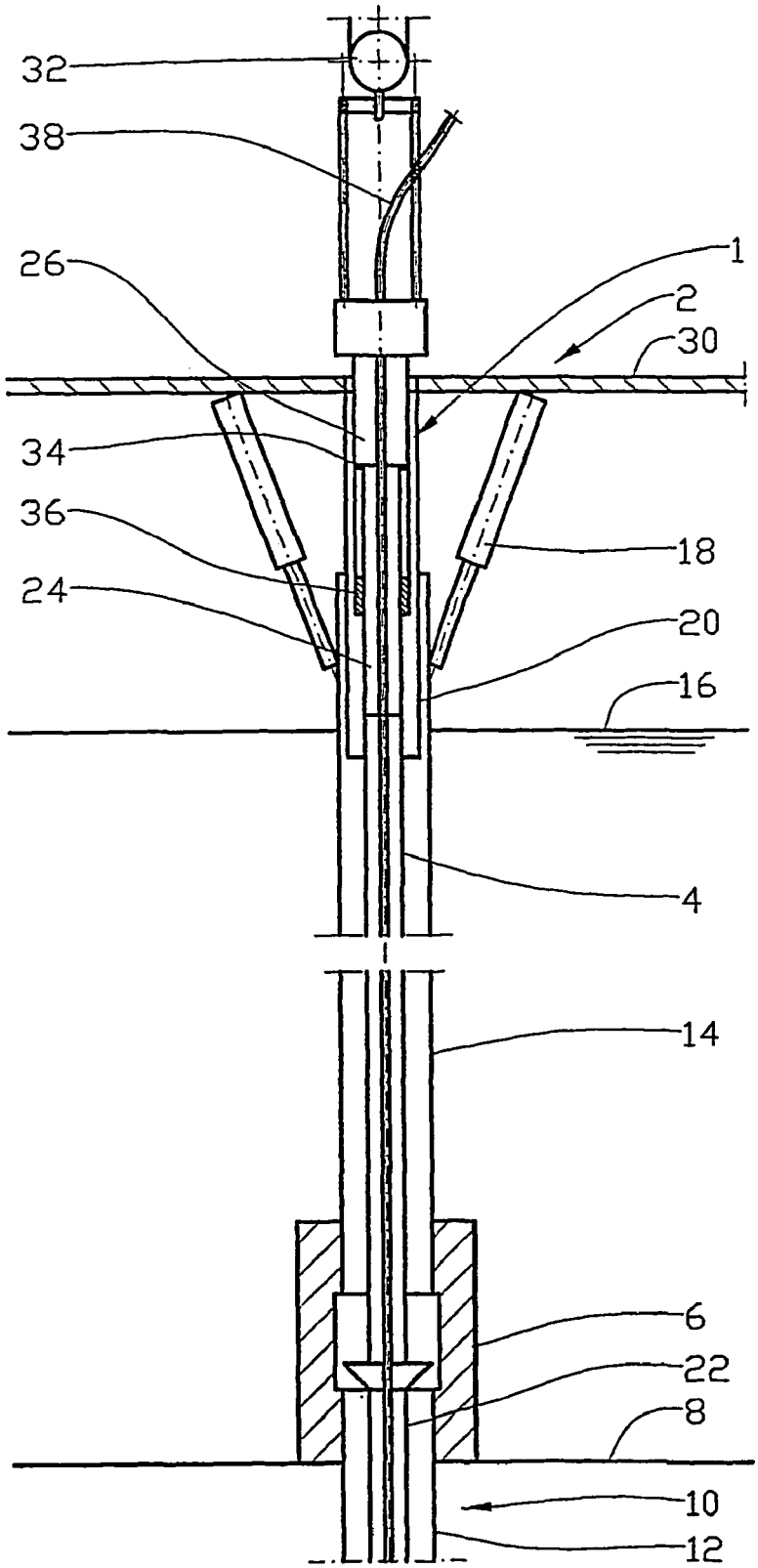
Figure 4:
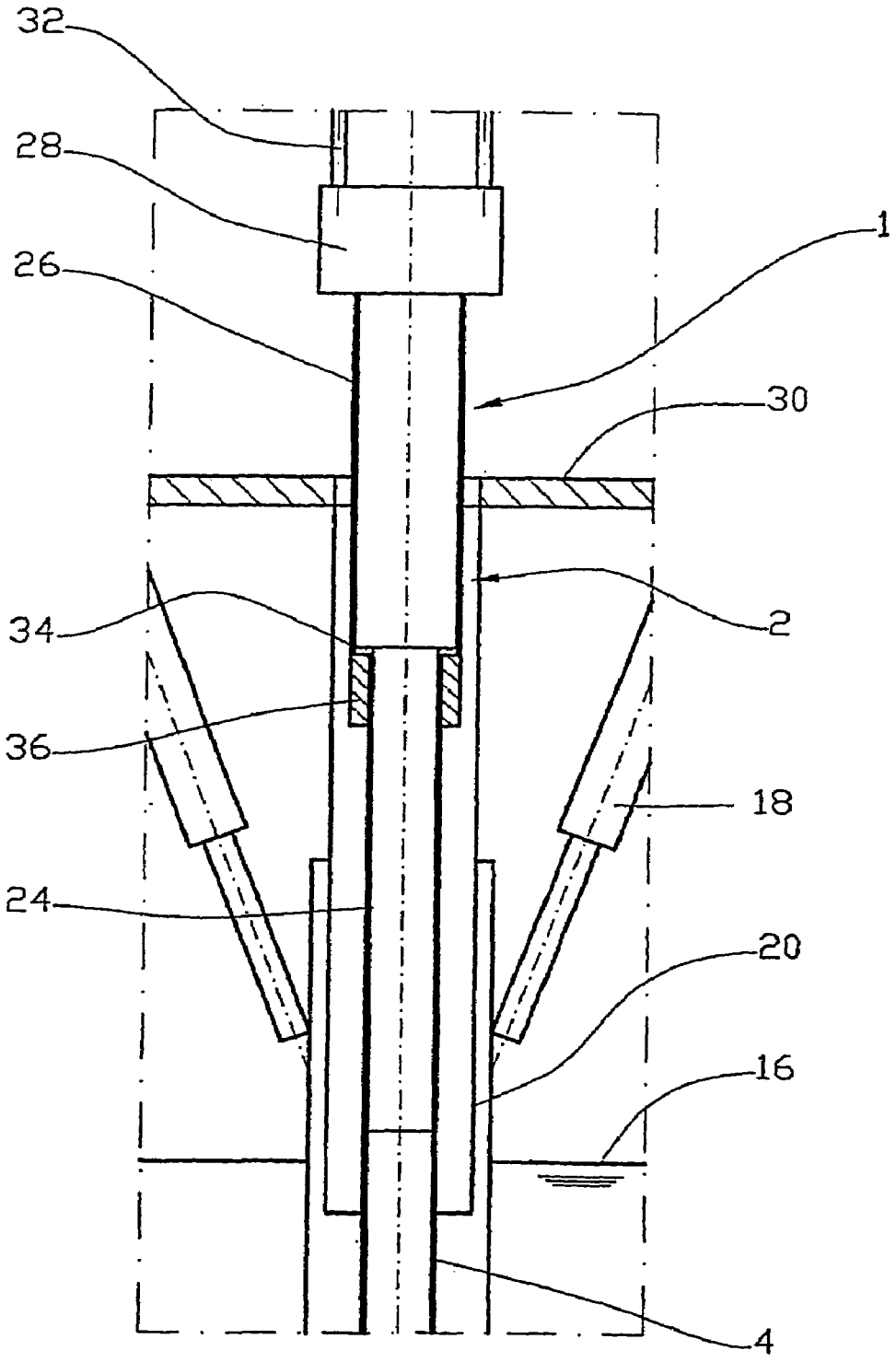

The following describes a non-limiting example of a preferred method and an arrangement for implementing the method, illustrated in the accompanying drawings, in which:

FIG. 1 schematically shows a workover riser equipped with a telescoping sliding connection, where the sliding connection is fully extended;

FIG. 2 schematically shows the sliding connection with the surface valve in the process of being lowered to the working deck of the vessel;

FIG. 3 schematically shows the sliding connection as the surface valve is placed on the working deck and coiled tubing is being run into the well; and FIG. 4 shows the sliding connection of FIG. 1 on a larger scale.

DETAILED DESCRIPTION OF THE INVENTION

In the drawings, reference number 1 denotes a telescoping sealing sliding connection connected onto the workover riser 4 of a vessel 2. A wellhead 6 is arranged on the seabed 8 and connected to the casing 12 of a well 10. A riser 14 is connected to the wellhead 6, projecting up through the surface of the sea 16 and on up to where it is connected to the vessel 2 by means of a heave compensator device 18. A telescopic pipe 20 is connected to the vessel 2 and designed to be displaced in the riser 14.

A production tubing 22 is arranged in the well 10 and hung off in the wellhead 6. From the vessel, the workover riser 4 projects down to the wellhead 6, where the workover riser 4 is communicatingly connected to the production tubing 22.

The telescoping sliding connection 1 comprises a lower inner telescopic pipe 24 fixed to the workover riser 4 and an upper outer telescopic pipe 26 connected to a surface valve 28. The surface valve 28 is arranged over the working deck 30 of the vessel 2 and suspended from a traveling block 32.

The lower telescopic pipe 24 has a smooth outside cylindrical surface, and its upper end portion is equipped with a radial outwardly projecting, enclosing flange 34.

At its lower end portion, the upper telescopic pipe 26 is equipped with an end gable 36 comprising a sealing device (not shown) of a type that is known per se, which sealing device is designed to provide a sliding seal against the outside cylindrical surface of the lower telescopic pipe 24.

When the workover riser 4 is to be pressurized, the telescoping sliding connection 1 is extended until the flange 34 stops against the end gable 36, see FIG. 1. In this position it is possible to transfer the occurring tension load, including the required pretensioning force, via the tensioner 32, whereby normal well operations can be carried out.

When rigging work such as the sluicing in tool strings by means of e.g. coiled tubing 38 or cable equipment is to be carried out, the pressure in the workover riser 4 is relieved, whereupon the surface valve 28 is lowered to the working deck 30 as the upper telescopic pipe 26 is lowered over the lower telescopic pipe 24, see FIG. 2. The weight of the workover riser 4 and the lower telescopic pipe 24 is carried by the wellhead 6. Rigging work, and to some extent completion and intervention operations, can be carried out with the surface valve in this for the operator highly favorable position, see FIG. 3. The heave motion of the vessel 2 is absorbed by the telescoping sliding connection 1 when the surface valve 28 is lowered in the working deck 30.

In the case of operations that may require pressurization of the workover riser 4, the telescoping sliding connection 1 is extended and pretensioned in a known manner by means of the traveling block 32.

An umbilical (not shown) used for communication with the wellhead 6 may be tensioned by means of a constant tension winch (not shown).

An arrangement according to the invention would also remedy malfunctions that might occur in the traveling block 32 or any other adjoining lifting and compensating equipment.

The invention claimed is:

1. An arrangement for well completion and intervention operations comprising:

a workover riser projecting from a wellhead and up to a vessel; and a telescoping connection connected to an upper portion of the workover riser, the telescoping connection comprising telescoping pipes, wherein the telescopic connection when fully extended is designed to carry the weight and pressure forces of the workover riser across the telescoping connection, and wherein a flange connected to one of the telescoping pipes abuts an end gable the other telescoping pipe when the telescopic connection is fully extended.

2. The arrangement in accordance with claim 1, wherein the telescoping connection is designed to withstand pressure.

* * * * *